United States Patent [19]

Knowlton et al.

[11] Patent Number: 4,981,184

[45] Date of Patent: Jan. 1, 1991

[54] DIAMOND DRAG BIT FOR SOFT FORMATIONS

[75] Inventors: R. Helene Knowlton; Michael G. Azar, both of Houston, Tex.

[73] Assignee: Smith International, Inc., Houston, Tex.

[21] Appl. No.: 274,169

[22] Filed: Nov. 21, 1988

[51] Int. Cl.[5] ..... E21B 10/46

[52] U.S. Cl. ..... 175/329; 175/397

[58] Field of Search ..... 175/329, 393, 397, 401, 175/410; 76/108 A

[56] References Cited

U.S. PATENT DOCUMENTS

| | | | |
|---|---|---|---|
| 4,554,986 | 11/1985 | Jones | 175/397 |
| 4,629,639 | 7/1987 | Barr et al. | 175/329 |
| 4,660,659 | 4/1987 | Short, Jr. et al. | 175/329 |

FOREIGN PATENT DOCUMENTS

| | | | |
|---|---|---|---|
| 2095724 | 10/1982 | United Kingdom | 175/329 |

OTHER PUBLICATIONS

Doctoral Thesis Entitled: "A Parabolic Yield Condition for Anisotropic Rocks and Soils", Michael Berry Smith, May, 1974.

Publication of Prentice Hall Entitled: "Advanced Strength of Materials", Voltera and Gaines, 1971.

*Primary Examiner*—William P. Neuder

*Attorney, Agent, or Firm*—Robert G. Upton

[57] ABSTRACT

A drag bit for soft formation is disclosed which consists of a new cutting mechanism. The drag bit face forms one or more pairs of radially disposed ridges separated by a valley whereby a leading ridge supports multiple rounded projections and the following ridge supports multiple positive rake angle cutters. The rounded projection elements move aside an elastic earth formation and the separated and trailing cutters clip off the dislodged formation to advance the bit in a borehole.

13 Claims, 3 Drawing Sheets

DIAMOND DRAG BIT FOR SOFT FORMATIONS

BACKGROUND OF THE INVENTION

1. Field of the Invention

This invention relates to diamond drag bits.

More particularly, this invention relates to diamond drag bits for soft sticky shale like earth formations.

2. Description of the Prior Art

Young earth formations that fail in the elastic mode or low end of the plastic range such as the Kaolinitic shales and high percent smectite shales typically found in tropical deposition zones are very difficult to drill.

Limited success has been achieved by soft formation roller cone bits and some fishtail type blade bits.

The roller cone bits easily become clogged with the clay like formation severely restricting the penetration rate of the bit.

Fishtail blade bits, prior to diamond bits, wear out very quickly requiring numerous bit changes resulting in prohibitive "tripping" cost wherein all of the drill pipe must be removed from the borehole prior to replacing the bit.

The performance of conventional diamond drag bits has been unsatisfactory due to the fact that the diamond cutters become clogged with the clay like shales thereby inhibiting bit penetration.

Diamond fishtail blade bits also have bottomhole cleaning problems that severely limit bit penetration rate.

A new cutting mechanism for failing rock is disclosed which overcomes the inadequacies of the prior art. The new cutting mechanism is neither a compression failure mode typical of rotary cone rock bits nor a pure shear failure mode typical of a diamond drag bit.

SUMMARY OF THE INVENTION

It is an object of the present invention to remove sticky or pseudo-elastic clay like soft material from an earth formation to quickly advance a drag bit in a borehole.

More specifically, it is an object of the present invention to provide a drag bit cutter with a new cutting mechanism, the bit having a rounded leading projection which moves aside an elastic earth formation so that a trailing, positive rake angle cutter element can clip off the rebounded dislodged formation to advance the bit in a borehole.

A diamond drag bit is disclosed for relatively soft clay like earth formations. The drag bit forms a body having a first opened threaded pin end and a second cutting end. The pin end is adapted to be threadably connected to an hydraulic fluid or "mud" transporting drill string. The cutting end of the drag bit body consists of a drag bit face, the face forming at least one rounded projection which extends from the bit face. The rounded projection is positioned radially from a center of the bit face. The bit face further forms at least one positive rake angle cutter projection that is strategically spaced from the rounded projection. The cutter is positioned in substantially a trailing location behind the rounded projection. The trailing cutter projection serves to cut off the earth formation that is moved aside by the leading rounded projection when the drag bit is rotated in a formation. The drag bit is thus advanced to further penetrate the formation.

At least one nozzle is formed in the drag bit face. The nozzle serves to direct the mud toward a borehole bottom formed in the earth formation and across the drag bit face, thereby removing debris or detritus from the borehole bottom while cleaning and cooling the cutting face of the drag bit.

An advantage then, of the present invention over the prior art, is the incorporation of a new cutting mechanism that takes advantage of an harmonic failure mode whereby a lead rounded projection sets up an incident long wave such that a critically spaced trailing cutter catches the rock harmonic i.e., the trailing cutter clips off the moved aside or displaced formation thereby removing it from the earth formation.

Prior art soft formation bits have difficulty in removing the clay like formations because of the resiliency of the formation. The cutter elements tend to push aside the formation as it is rotated in the formation. The resilient formation, however, reforms or rebounds behind the cutters thus inhibiting advancement of the bit in the borehole.

More particularly, an advantage of the present invention over the prior art is the use of a leading domed insert to initiate the harmonic wave in the elastic formation, the moved formation being clipped off by a critically spaced positive rake angle trailing cutter.

The above-noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
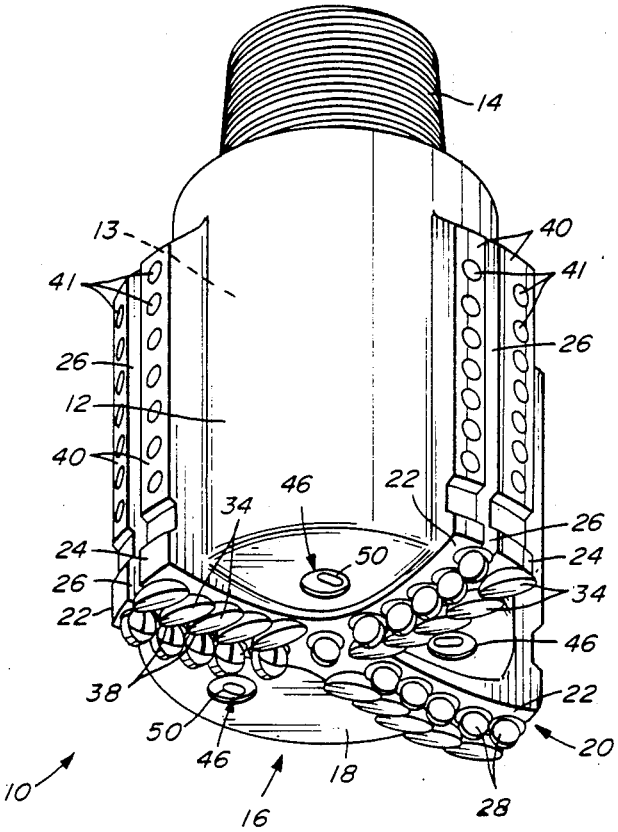
FIG. 1 is a perspective view of a preferred embodiment of the present invention illustrating the soft formation drag bit.

With reference to the perspective view of FIG. 1, the drag bit, generally designated as 10, consists of a drag bit body 12 having an opened threaded pin end 14 and at an opposite cutting end generally designated as 16. A cutting face 18 of cutting end 16 comprises radially disposed pairs of ridges and valleys generally designated as 20. A first radially disposed ridge 22 is spaced from a trailing radially disposed ridge 24 by a flow channel 26. Ridges 22 and 24 are separated by the flow channel 26, the flow channel 26 extending down the length of the bit. The elongated channel 26 is substantially aligned with the axis of the bit after it transitions from the cutting face 18 to the side of the bit 10. The channel 26 is formed between gauge row ridges or pads 40. The ridges 40 may have, for example, a multiplicity of substantially flat tungsten carbide inserts, or diamond enhanced inserts, 41 pressed into holes formed in the gauge pads 40.

Figure 3:
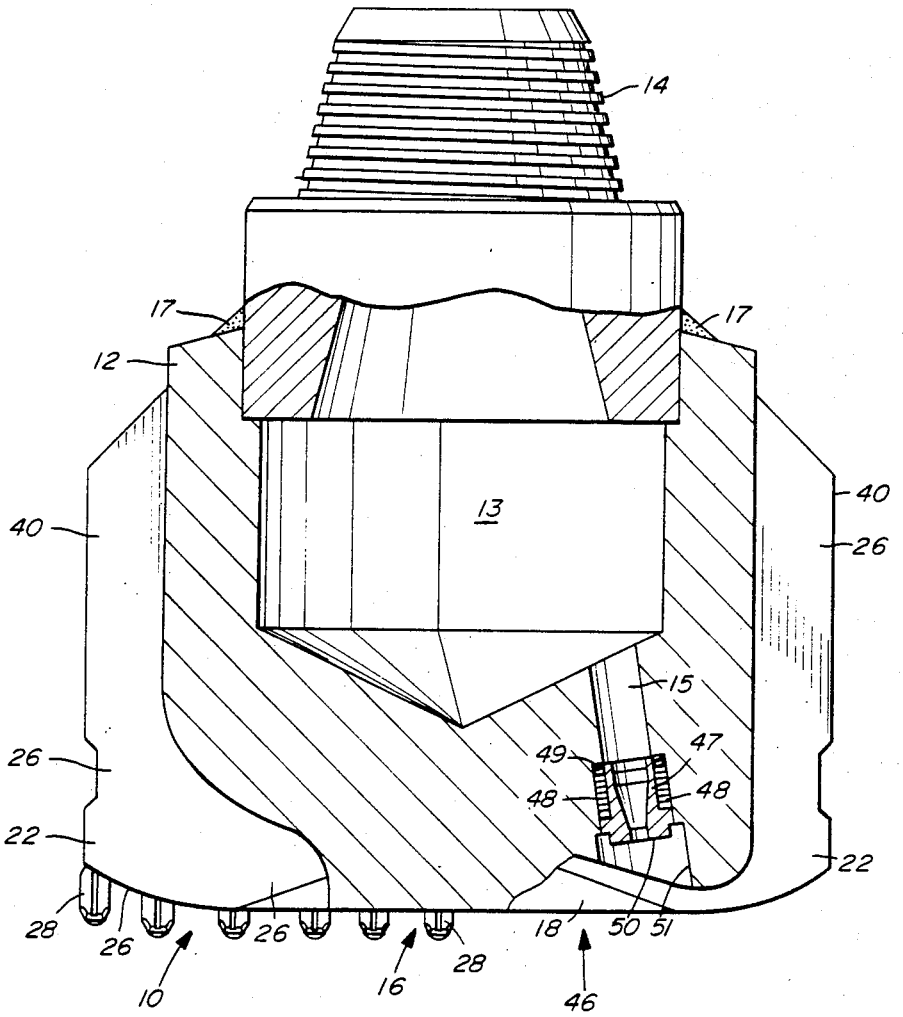
FIG. 3 is a view taken through 3—3 of FIG. 2 showing a partially cut-away section of the drag bit illustrating one of the nozzles formed in the drag bit face.

An interior of the drag bit body 12 defines an hydraulic chamber 13. The hydraulic chamber or cavity 13 is in fluid communication with the open pin end 14 of the bit 10. Nozzles, generally designated as 46, are positioned between the pair of ridges 20 in the bit face 18. Nozzles 46 communicate with chamber 13 via channel 15 formed by the bit body 12 (FIG. 3).

Figure 7:
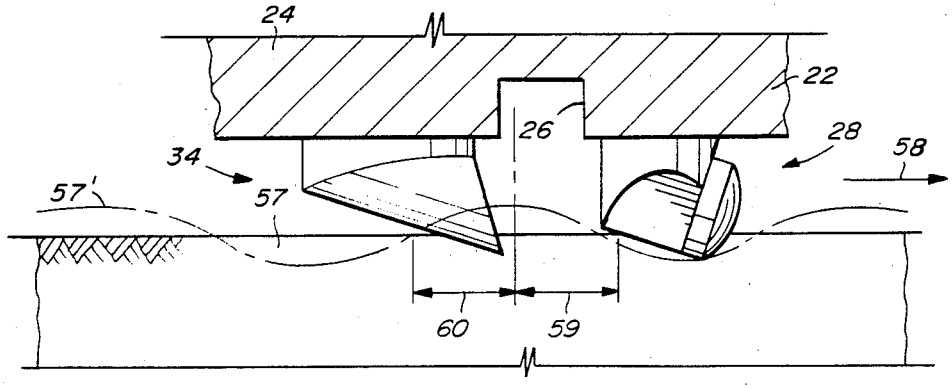
FIG. 7 is a schematic view of a portion of the drag bit as it works in a borehole, the leading rounded insert and the trailing, spaced apart cutter insert with a positive rake angle is strategically positioned to take advantage of a sinusoidal wave of the elastic formation as the drag bit works against the bottom of a borehole.

Ridge 22 supports a plurality of domed cutter inserts generally designated as 28. The cutters 28 are strategically positioned along the ridge 22 to cover the entire borehole bottom 57 (FIG. 7). The inserts 28 have their domed cutting faces pointed in the direction of rotation "A" of the bit, each of the dome cutters 28 being secured within apertures 32 formed in the ridge 22. Typically, these types of hardened inserts are brazed or pressed into their respective apertures 32 through an interference fit, thus securing and orienting each of the dome cutters towards the direction of rotation ("A") of the bit 10. A substantially parallel ridge 24 supports a plurality of positive rake angle cutters generally designated as 34. Each of the cutters 34 are spaced from the leading dome cutters 28 by the flow channel 26. Moreover, each of the cutters 34 are strategically placed and positioned substantially in a trailing location behind each of the dome cutters 28 to remove as much of the formation as possible as the bit works in a borehole. The cutting edge 38 of the cutters 34 are oriented towards the direction of rotation "A" of the bit 10. The rounded positive rake angle surface 43 defining cutting edge 38 has an orientation substantially at a positive rake angle with respect to a centerline of the bit 10 as is clearly shown in FIGS. 4, 5 and 7.

The positive rake angle stud cutters 34 may be fabricated from, for example, tungsten carbide with or without diamond materials impregnated or bonded with the carbide. The curved cutting edge 38 and curved leading edge surface 43 of the stud cutter 34 serves to reduce the force of the formation across insert 34 by providing less resistance to the formation.

State-of-the-art polycrystalline diamond cutter inserts generally have a negative rake angle for attacking harder, plastic or brittle formations where it is of equal importance to protect the cutter from vibration induced chattering on the borehole bottom. The prior art cutters are used primarily in a shear drilling mode as heretofore stated. Elastic and pseudo-elastic formations deflect or extrude depending upon the clay material rather than offering enough resistance for efficient shearing action which would, of course, be appropriate for prior art type negative rake angle cutters.

The preferred drag bit as illustrated with respect to FIGS. 1, 2, 3 and 4 is ideally suited to operate in very resilient clay like formations.

For example, single element cutting tests were performed on Pierre shale. This shale has a clay content of nearly 60 percent most of which is smectite-based. Its unconfined compressive strength is about 660 psi. As a contrast, for example, Carthage marble has a compression strength of 17 to 25,000 psi and Mancos has a compressive strength of from 9 to 15,000 psi. Under tests of borehole pressure conditions of 1,000, 1,500 and 2,000 psi the Pierre shale rock remains in its elastic state as well as being very hydratable. The test bit had a single dome cutter in the lead trailed by a pair of spaced apart positive rake angle cutters (not shown). The foregoing configuration was decided upon to test the theory that the lead dome cutter extrudes the formation past the cutter to stretch the rock to its elastic limit while the positive rake angle trailing cutter serves to shear the deflected formation off. A most successful test was conducted using an intermediate spacing, or pitch, between the lead dome cutter and the two trailing positive rake angle cutters.

The bit was rotated in a test rig into the Pierre shale at about 60 rpm with only 35 gallons per minute of hydraulic fluid or "mud" undirected flow across the 7.4 inch diameter test bit. The results of this test run were astonishing. The test bit came out of the test rock clean, void of any packing of any detritus against the face which is typical of standard drag bit type diamond bits run in this kind of formation (Pierre shale). Where you would normally see conventional cutters used in Pierre shale or the like come out of the hole with clumps or gobs of cuttings jammed against the conventional bits; in the test bit, the cuttings came out in a perfect ribbed pattern just as though the formation being cut was much harder or brittle in nature. This is due primarily to the fact that the intercellular water is altered by the mechanical stress induced by the lead cutter moving through the formation. The deformation caused by the leading domed cutter stresses the formation to its elastic limit. The trailing cutters clip off the deformed formation thus producing clean cuttings that are easily removed from the borehole bottom. These cuttings hold their integrity after being dried, unlike other Pierre shale cuttings from conventional bits. This is due to the water loss caused by the action of the bit working in the hydratable formation.

What has emerged from the foregoing tests is a new cutting mechanism for failing rock which is neither a compressive failure mode nor a pure shear failure mode. An harmonic failure mode for the rock is set up whereby the lead dome cutter sets up an incident long wave while the trailing cutter is critically spaced to catch the rock harmonic.

FIG. 7 illustrates the harmonic wave or elastic formation wave 57' as the bit 10 is rotated in a formation 56 This harmonic wave is primarily set up by the lead domed cutter 28. The borehole bottom 57 formed in formation 56 is however, also harmonically disturbed by the interaction of a combination of elements i.e., the domed cutters 28, the speed of rotation of the bit 10 and the WOB/TOB (weight-on-bottom/torque-on-bottom). The wave 57' rebounds behind the lead domed cutter 28. This wave portion is represented as 59 in the schematic of FIG. 7. The peak of the rebounded formation 60 ideally occurs just in front of the trailing positive rake angle cutter so that the cutter may clip off a maximum amount of the extended formation created by the harmonic wave 57' on the borehole bottom 57.

The phenomenon of the behavior of anisotropic rocks, such as Pierre shale and the like, was the subject of a doctoral thesis entitled *A Parabolic Yield Condition for Anisotropic Rocks and Soils* by Michael Berry Smith of Rice University (Houston, Tex.) and submitted May, 1974. This paper delves into rock formations exhibiting properties with different values when measured along axes in different directions. The study looks at rock formations that assume different positions (harmonic waves) in response to external stimuli (the rock bit 10 of the present invention) and is hereby incorporated by reference.

Another reference entitled *Advanced Strength of Materials* by authors Voltera and Gaines is a Prentice Hall publication dated 1971 and is also hereby incorporated by reference. A chapter beginning on page 417 deals with deflections of circular beams resting on elastic foundations and a method of harmonic analysis follows. These mathematical solutions solve symmetric and non-symmetric loading of circular beams on elastic soil formations.

Figure 2:
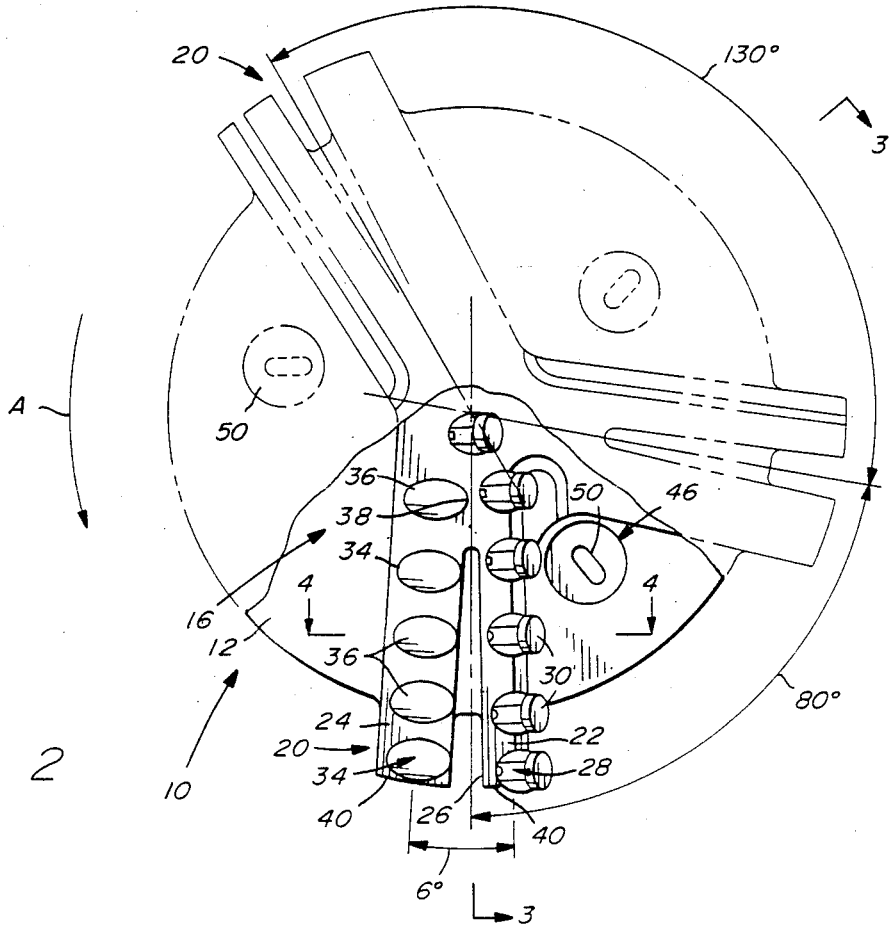
FIG. 2 is a top view of the drag bit shown in FIG. 1 illustrating the relationship of the leading and trailing elements in each segment of the drag bit.

A preferred three-bladed bit 10 will have a 6 degree ridge separation for each pair of radially disposed ridges 22 and 24 as illustrated on FIG. 2 to optimize bit penetration. However, the ridge separation may be between 3 and 10 degrees. In a specific example, the bit size is 8 ½ inches in diameter. The bit rotational speed is 160 to 180 RPM and the weight on the bit is relatively light (between 2 and 10,000 lbs).

The preferred asymmetric blade separation shown in FIG. 2 of 80, 130 and 150 degrees serves to minimize bit vibration and keep the bit on bottom when the bit is rotated in the borehole. This orientation also helps to maximize bit penetration. Moreover, the non-symmetric nozzle opening 50 of nozzle 46 substantially prevents the nozzle from plugging while directing a generous flow of fluids across the bit face 18 as heretofore described.

The partially broken away top view of the cutting end 16 of the bit 10 illustrates the relationship of the radially disposed ridges 22 and 24 and the separating flow channel 26 therebetween. The radial orientation of ridge 22 and 24 are preferably separated by approximately 6 degrees to provide the proper spacing between the lead dome cutter 28 and the trailing positive rake angle cutter 34. Again, the domed lead type cutters 28 are strategically positioned along the length of the raised ridge 22. The first or inner domed cutter 28 is offset radially slightly from the center of the bit body 12. The rest of the leading dome cutters 28 are about equidistantly spaced along the top of the ridge 22 to best cover the entire borehole bottom (57 of FIG. 7) to maximize penetration of the bit in a borehole. Ridge 24 supports a multiplicity of trailing cutters 34. Each of the trailing cutters is positioned substantially behind each of the dome cutters 28. Each of the trailing cutters 34 are, for example, brazed into insert holes 39 formed in the ridge 24. The cutting edge 38 being so oriented to face towards the direction "A" of rotation of the bit.

The nozzles, generally designated as 46, are preferably configured with an asymmetrical elongated slot 50 in the exit end of the nozzle. The slot 50 serves to direct hydraulic mud through the nozzle in such a manner as to maximize cross-flow of fluid across the face 18 of the bit 10. The hydraulic mud serves to remove large cuttings from the bottom of the formation while serving to cool and clean the cutters in the bit.

Turning now to FIG. 3, the bit is shown partially in cross-section illustrating the fluid chamber 13 formed by bit body 12 of the bit 10. The nozzles 46 are in communication with chamber 13 through channel 15. The nozzles 46 are, for example, fabricated from tungsten carbide. The nozzle body 47 has metallurgically bonded thereto a threaded sleeve 48 which in turn is threaded into a threaded passageway 51 formed in bit body 12. An O-ring 49 is seated at the base of the nozzle body 46 to prevent erosion around the entrance to the nozzle 46. An elongated slot 50 (see FIG. 1 and 2) is formed by he bit body 47 to maximize and to direct fluid flow across the bit faces as heretofore described.

The fluid channels 26 are clearly shown formed in the bit body 12. Channel 26 begins its radial orientation near the centerline of the bit body and progresses across the bit face 18 transitioning into the vertically aligned slots 26 formed between the gauge row pads 40. The flow slot or channel 26 essentially parallels the axis of the bit 10.

As illustrated in FIG. 3, the bit body may be fabricated from a pair of assemblies, namely, a bit body 12 and a separate pin end section 14. The lower portion 14 is preferably interfitted within the bit body 12. The whole assembly, for example, is welded at junction 17 to complete the bit. This type of assembly allows all of the passages, for example, the flow passage 15 and the opening forming the chamber 13, to be formed in the body 12 prior to assembly of the pin end into the body.

Figure 4:
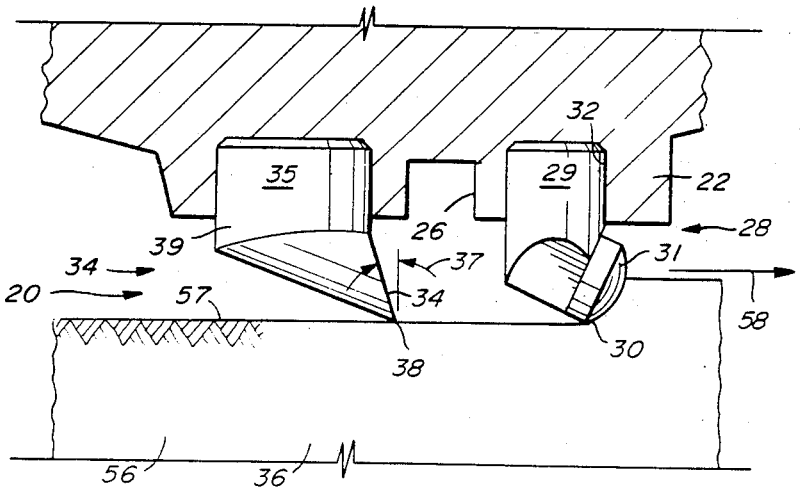
FIG. 4 is an enlarged view of a section of the cutting face illustrating the leading rounded projection followed by a trailing substantially aligned cutter projection having a positive rake angle.

Turning now to FIG. 4, a single cutter assembly, generally designated as 20, consists of a pair of radially disposed ridges 22 and 24 separated by a flow channel 26 formed therebetween. Ridges 22 and 24 are separated along radial lines by about from 3 to 10) degrees. A preferred separation is 6 degrees to provide an optimum spacing between the leading dome cutter 28 and the trailing positive rake angle cutter 34.

As the bit works in a borehole along a direction indicated by 58 (direction "A" of FIGS. 1 and 2) the leading dome cutter 28 is embedded into the formation 56. The dome face 31 of insert 28 is forced into the soft sticky formation, thus extruding the formation around the dome cutter face 31. The trailing cutter 34 is slightly larger in diameter and longer in length and serves to shear or clip off the extruded formation as the bit is rotated in the borehole bottom 57 of the formation 56.

As previously indicated, without the trailing cutter 34, the negative rake angle cutter inserts of the prior art would simply extrude the material around the cutter, the material closing in substantially behind the prior art cutter without penetrating the borehole bottom. By clipping off these extruded wave generated sticky-like formations the advancement of the bit 10 in the borehole is rapid due to the fact that large amounts of detritus are being removed from the borehole bottom by the unique method herein described.

Figure 5A:
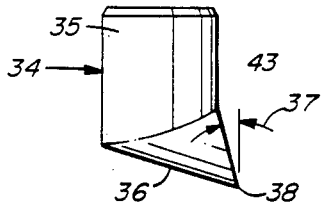
FIGS. 5*a, b* and *c* are side, front, and top views of the trailing cutter projection showing a positive rake angle that is pointed in the direction of rotation of the drag bit.
Figure 6A:
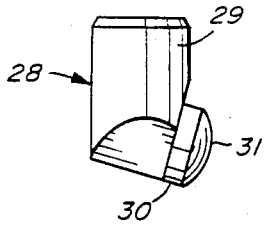
FIGS. 6*a, b,* and *c* illustrate side, front, and top views of the leading rounded insert secured within the face of the drag bit.
Figure 5B:
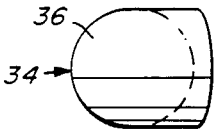
Figure 6B:
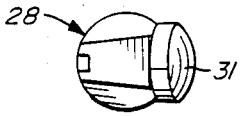
Figure 5C:
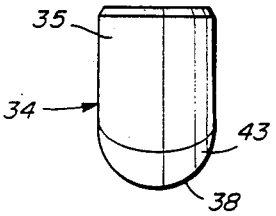
Figure 6C:
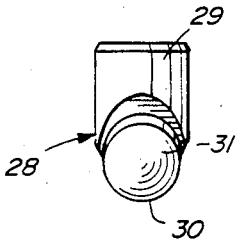

Turning now to FIGS. 5*a, b* and *c* the trailing positive rake angle cutter 34 is shown in detail. The cutter 34 consists of a base portion 35 which is normally interference fitted within an insert hole 39 formed in the ridge 24 (See FIG. 4.) The cutting end 38 of the bit 34 is curved in shape as shown in FIG. 5*b*, the top 36 of the cutter 34 being relatively flat. In directional applications, a more parabolic profile would be better. The cutting tip 38 and face 43 of the trailing positive rake angle cutter 34 is curved to minimize the stress of the cutter coming in contact with the formation 56. The positive rake angle 37 is between 5 and 15 degrees. A preferred rake angle is 10 degrees. This configuration acts very efficiently in soft formations. The insert 34 attacks these clay like soft hydratable formations shearing them off as the bit works in a borehole as heretofore described. The top 36 of the cutter 34 is, for example, substantially flat and has an angle with respect to the borehole bottom 57 of about 20 degrees.

A typical insert, for example, might be three-quarters of an inch in diameter and about an inch and a quarter long with approximately half of this length being exposed above the face 18 of the bit body 12. These inserts are typically fabricated from tungsten carbide as heretofore stated.

A diamond face may be provided along cutting edge 38 both along the positive rake angle cutting surface 43 and/or the top 36 of the insert 34. (Not shown.)

With reference to FIGS. *6a, b* and *c* the domed cutters, generally designated as 28, consist of an insert body 29 and a cutting end 30. The cutting end comprises a disc of tungsten carbide that has a domed or convex surface 31 of polycrystalline diamond material. The disc is normally brazed to the body 29 of the insert 28. The dome cutting face 31 is generally oriented at a negative rake angle which is, of course, standard with the diamond rock bit art. The domed insert bodies 29 are generally fabricated from tungsten carbide as well. These inserts, for example, are about five-eighths of an inch in diameter and about one and one-eighth inch in length and are designed to cooperate with the positive rake angle insert illustrated in FIGS. *5a, b* and *c*.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A drag bit for relatively soft earth formations, said drag bit forming a body having a first opened pin end and a second cutting end, said pin end being adapted to be threadably connected to a mud transporting drill string, said cutting end of said drag bit body comprising;

a drag bit face, at said cutting end of said bit, said face containing at least one rounded projection extending from said face, said rounded projection extending from said face is a tungsten carbide insert having a first base end and a second cutting end, said second cutting end being a rounded, dome shaped polycrystalline diamond bonded to said tungsten carbide insert;

said face further containing at least one cutter insert projection spaced from said rounded dome shaped insert projection and positioned substantially in a trailing location behind said at least one rounded insert projection, said at least one trailing cutter is an insert having a first base end and a second cutting end, said second cutting end forms a cutting edge with a positive rake angle with respect to said borehole, said cutting edge substantially faces the direction of rotation of said drag bit, said trailing cutter projection serves to cut off the earth formation moved aside by the leading rounded projection when said drag bit is rotated in the earth formation thereby advancing the drag bit to further penetrate a borehole formed in said formations; and at least one nozzle formed in said drag bit face, said nozzle serves to direct said mud toward a borehole bottom formed in said earth formation and across said drag bit face thereby removing detritus from the borehole bottom and cooling and cleaning the drag bit face.

2. The invention as set forth in claim 1 wherein said cutting edge and positive rake angle surface adjacent thereto formed by said insert is rounded.

3. The invention as set forth in claim 1 wherein there is a multiplicity of rounded insert projections strategically positioned in said drag bit face and a multiplicity of cutter insert projections substantially spaced from and trailing said rounded insert projections, said rounded insert projections and cutter inserts being so positioned to maximize the penetration rate of said drag bit in said formation.

4. The invention as set forth in claim 3 wherein there is an equal number of rounded insert projections and cutter insert projections in said drag bit face.

5. The invention as set forth in claim 4 wherein said drag bit face further forms substantially radially disposed ridges and valleys, said ridges and valleys extend substantially from said center of said bit, said ridges support said rounded insert projections and said trailing insert cutters and said valleys serve to direct said hydraulic mud across said drag bit face to cool and clean said rounded insert projections and said trailing insert cutters and to remove detritus cut from said earth formation.

6. The invention as set forth in claim 5 wherein said ridges and valleys form at least one pair of radially disposed ridges separated by a valley, a first ridge forms a base for said multiplicity of rounded projection inserts, said base end of said insert being secured within insert holes formed by said first ridge, a second ridge separated by one of said valleys forms a base for said multiplicity of trailing positive rake angle cutter inserts, said base end of said cutter inserts being secured within insert holes formed by said second ridge.

7. The invention as set forth in claim 6 wherein said pair of radially disposed ridges are separated by said valley by from 3 to 10 degrees.

8. The invention as set forth in claim 7 wherein the ridges are separated by said valley by 6 degrees.

9. The invention as set forth in claim 8 wherein there are three pairs of radially disposed ridges separated by valleys formed by said drag bit face.

10. The invention as set forth in claim 9 wherein said three pairs of ridges are separated asymmetrically around the circumference of said bit face.

11. The invention as set forth in claim 10 wherein a first pair of radially disposed ridges separated by said valley is separated from a second pair of ridges by about 80 degrees, a third pair of ridges is separated from said second pair of ridges by about 130 degrees, and said third and first pair of ridges is separated by about 150 degrees.

12. The invention as set forth in claim 11 wherein a nozzle is positioned in said bit face in each 80, 130 and 150 degree segment between said pairs of ridges and valleys.

13. The invention as set forth in claim 1 wherein said nozzle forms an elongated slot at an exit plane of said nozzle, said slot enables said mud exiting said slot to be directed in a manner to maximize flow across said bit face.

* * * * *